US010279951B2

(12) United States Patent
Walling et al.

(10) Patent No.: US 10,279,951 B2
(45) Date of Patent: May 7, 2019

(54) CARTON AND CARTON BLANK

(71) Applicant: WestRock Packaging Systems, LLC, Norcross, GA (US)

(72) Inventors: Bradford J. Walling, Chesterfield, VA (US); Caleb S. Loftin, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/548,003

(22) PCT Filed: Jan. 29, 2016

(86) PCT No.: PCT/US2016/015609
§ 371 (c)(1),
(2) Date: Aug. 1, 2017

(87) PCT Pub. No.: WO2016/126541
PCT Pub. Date: Aug. 11, 2016

(65) Prior Publication Data

US 2018/0022501 A1 Jan. 25, 2018

Related U.S. Application Data

(60) Provisional application No. 62/111,387, filed on Feb. 3, 2015.

(51) Int. Cl.
*B65D 5/54* (2006.01)
*B65D 71/36* (2006.01)
(Continued)

(52) U.S. Cl.
CPC ..... *B65D 5/541* (2013.01); *B65D 5/02* (2013.01); *B65D 5/0227* (2013.01);
(Continued)

(58) Field of Classification Search
CPC ..... B65D 5/541; B65D 5/02; B65D 5/4266; B65D 5/46192; B65D 71/36;
(Continued)

(56) References Cited

U.S. PATENT DOCUMENTS 3,894,681 A 7/1975 Arneson et al.
5,249,681 A 10/1993 Miller
(Continued)

FOREIGN PATENT DOCUMENTS

WO WO2005/042370 A1 5/2005

*Primary Examiner* — Christopher Demeree
(74) *Attorney, Agent, or Firm* — WestRock Intellectual Property Group

(57) ABSTRACT

A carton (90) for packaging one or more articles (A) includes a plurality of panels (12, 14, 16, 18) for forming a tubular structure. The plurality of panels include a top panel (16) and a pair of first and second opposed side panels (14, 18) hingedly connected to first and second opposite sides of the top panel respectively. The first and second side panels include first and second corner edges (C2, C1) respectively which are free of hinged connection to any other part of the carton. The first and second corner edges extend from the first and second sides of the top panel respectively. The carton includes a first severance line (70) extending from the first corner and a second severance line (78) extending from the second corner edge.

13 Claims, 10 Drawing Sheets

(51) Int. Cl.

| | |
|---|---|
| ***B65D 5/46*** | (2006.01) |
| ***B65D 5/02*** | (2006.01) |
| ***B65D 5/42*** | (2006.01) |
| ***B65D 5/72*** | (2006.01) |

(52) U.S. Cl.

CPC ..... *B65D 5/4204* (2013.01); *B65D 5/4266* (2013.01); *B65D 5/46192* (2013.01); *B65D 5/542* (2013.01); *B65D 5/725* (2013.01); *B65D 71/36* (2013.01); *B65D 2571/0045* (2013.01); *B65D 2571/0058* (2013.01); *B65D 2571/00141* (2013.01); *B65D 2571/00728* (2013.01)

(58) Field of Classification Search

CPC .... B65D 2571/0066; B65D 2571/0058; B65D 2571/00574; A47F 1/08; A47F 5/11

USPC ..... 229/242, 122.1, 122; 206/427, 494; 221/305, 302, 303

See application file for complete search history.

(56) References Cited

U.S. PATENT DOCUMENTS

| | | | | |
|---|---|---|---|---|
| 5,690,230 | A * | 11/1997 | Griffith | B65D 5/725 206/494 |
| 6,997,316 | B2 * | 2/2006 | Sutherland | B65D 71/36 206/427 |
| 7,000,803 | B2 | 2/2006 | Miller | |
| 7,367,453 | B2 | 5/2008 | Sutherland | |
| 8,881,901 | B2 | 11/2014 | Harrelson | |
| 2004/0188300 | A1 | 9/2004 | Sutherland | |
| 2005/0178791 | A1 | 8/2005 | Miller | |
| 2007/0069002 | A1 | 3/2007 | Gomes | |

* cited by examiner

CARTON AND CARTON BLANK

CROSS-REFERENCE TO RELATED APPLICATIONS

This application is a National Phase application of PCT Application PCT/US16/15609, filed Jan. 29, 2016, which claims the benefit of U.S. Provisional Patent Application No. 62/111387, filed Feb. 3, 2015, which is incorporated herein by reference in its entirety.

TECHNICAL FIELD

The present invention relates to a carton and blank for forming the same more specifically, but not exclusively, to a carton comprising a dispenser for facilitating access to the carton contents.

BACKGROUND

In the field of packaging it is often required to provide consumers with a package comprising multiple primary product containers. Such multi-packs are desirable for shipping and distribution purposes and for the display of promotional information. For cost and environmental considerations, such cartons or carriers need to be formed from as little material as possible and cause as little wastage as possible in the materials from which they are formed. Another consideration is the strength of the packaging and its suitability for holding and transporting large weights of articles.

It is desirable to provide a carton comprising a dispenser for facilitating access to the carton contents.

The present invention seeks to overcome or at least mitigate the problems of the prior art.

SUMMARY

According to a first aspect of the present invention there is provided a carton for packaging one or more articles. The carton comprises a plurality of panels for forming a tubular structure. The plurality of panels comprises a top panel and a pair of first and second opposed side panels hingedly connected to first and second opposite sides of the top panel respectively. The first and second side panels may comprise first and second corner edges respectively which are free of hinged connection to any other part of the carton. The first and second corner edges extend from the first and second sides of the top panel respectively. The carton comprises a first severance line extending from the first corner and a second severance line extending from the second corner edge. The top panel comprises a third severance line extending between the first and second severance lines.

Optionally, the first severance line extends into the first side panel from the first corner edge to the first side of the top panel. The second side panel may comprise a second severance line extending into the second side panel from the second corner edge to the second side of the top panel.

Optionally, the first severance line extends from the first corner edge along a hinged connection between the first side panel and the first side of the top panel. The second side panel may comprise a second severance line extending from the second corner edge along a hinged connection between the second side panel and to the second side of the top panel.

Optionally, the top panel comprises a free end edge extending between the first and second corner edges, the free end edge being free of hinged connection to any other part of the carton.

Optionally, the first and second end closure panels are hingedly connected to end edges of the first and second side panels respectively, and the end edges of the first and second side panels extend from the first and second corner edges respectively.

Optionally, the free end edge of the top panel is inset from an end edge of either one of the first and second side panels, the end edges of the first and second side panels extending from the first and second corner edges respectively.

Optionally, the top panel comprises a first tab integrally formed therewith, the first tab extending between the top panel and the first and second end closure panels.

Optionally, the first tab comprises first and second free side edges, the first and second free side edges being free of hinged connection to any other part of the carton.

Optionally, the first tab forms a part of a detachable portion for forming a dispenser for facilitating access to the carton contents.

Optionally, the top panel comprises first and second hinged connections to the first and second side panels respectively, and wherein the first and second free side edges are inset from the first and second hinged connections respectively.

Optionally, the top panel comprises a first hinged connection to the first side panel, the first hinged connection being shorter in length than the length of the first side panel.

Optionally, the top panel comprises a second hinged connection to the second side panel, the second hinged connection being shorter in length than the length of the second side panel.

Optionally, the first tab is adhesively secured to at least one of the first and second end closure panels.

Optionally, the first tab comprises at least one weakened region to facilitate separation of the first tab from said at least one of the first and second end closure panels.

Optionally, the at least one weakened region comprises one or more partial depth cuts such that an inner surface of one of the first tabs is separable from an outer surface of the first tab.

According to a second aspect of the present invention there is provided a blank for forming a carton. The blank comprises a plurality of panels for forming a tubular structure. The plurality of panels comprises a top panel and a pair of first and second opposed side panels. The first and second side panels may have first and second corner edges respectively which are free of hinged connection to any other part of the blank. The first and second corner edges extend from the first and second sides of the top panel respectively. The blank comprises a first severance line extending from the first corner edge and a second severance line extending from the second corner edge. The top panel comprises a third severance line extending between the first and second severance lines.

According to a third aspect of the present invention there is provided a carton for packaging one or more articles. The carton comprises a plurality of panels for forming a tubular structure. The plurality of panels comprises a top panel and a pair of first and second opposed side panels hingedly connected to the first and second opposite sides of the top panel respectively. The carton may comprise a first end closure panel coupled to the top panel for at least partially closing an open end of the tubular structure. The carton further comprises a dispenser having a removable portion struck at least in part from the top panel and defined at least in part by a severance line extending from a first free side edge of the end closure panel to a second opposing free side edge of the end closure panel. The end closure panel may be coupled to the removable portion and may be detachable together with the removable portion when the dispenser is deployed.

Optionally, the carton comprises a second end closure panel hingedly connected to the first side panel, the first end closure panel being adhesively secured to the second end closure panel.

Optionally, one of the first or second end closure panels comprises a first weakened region to facilitate separation of the first end closure panel from the second end closure panel, the first weakened region being adhesively secured to the other of the first and second end closure panels.

Optionally, the first weakened region is defined at least in part by one or more severance lines such that at least part of the first weakened region is separable from said one of the first and second end closure panels to remain secured to the other of the first and second end closure panels.

Optionally, the carton comprises a third end closure panel hingedly connected to the second side panel, the first end closure panel being adhesively secured to the third end closure panel.

Optionally, one of the first or third end closure panels comprises a second weakened region to facilitate separation of the first end closure panel from the third end closure panel, the second weakened region being adhesively secured to the other of the first and third end closure panels.

Optionally, the second weakened region is defined at least in part by one or more severance lines such that at least part of the second weakened region is separable from said one of the first and third end closure panels to remain secured to the other of the first and third end closure panels.

According to a fourth aspect of the present invention there is provided a blank for forming a carton. The blank comprises a plurality of panels for forming a tubular structure. The plurality of panels comprises a top panel and a pair of first and second opposed side panels. The blank may comprise a first end closure panel coupled to the top panel for at least partially closing an open end of the tubular structure. The blank further comprises a dispenser having a removable portion struck at least in part from the top panel and defined at least in part by a severance line extending from a first free side edge of the end closure panel to a second opposing free side edge of the end closure panel. The end closure panel may be coupled to the removable portion and may be detachable together with the removable portion when the dispenser is deployed.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
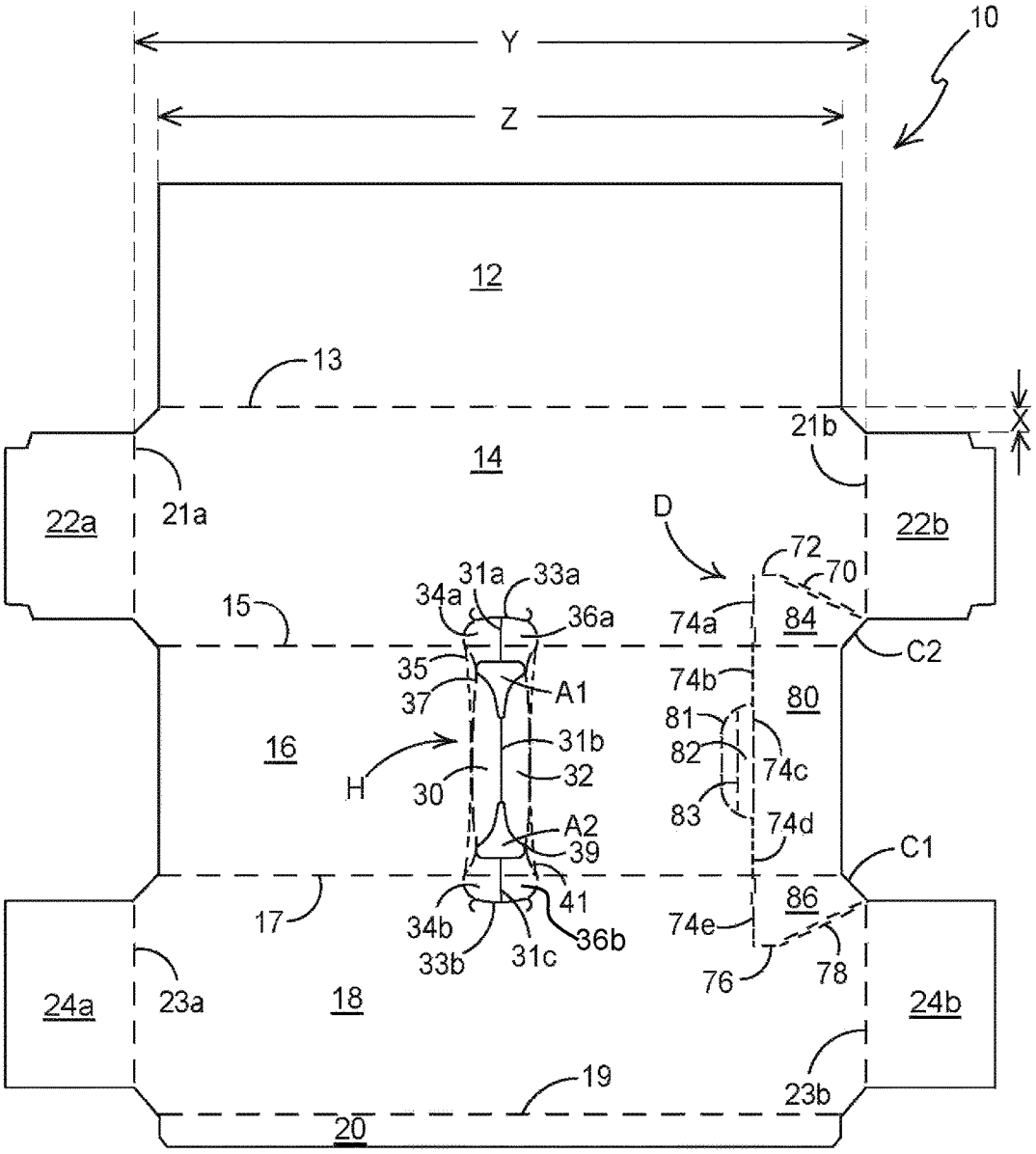
FIG. 1 is a plan view from above of a blank for forming a carton according to a first embodiment of the invention.
Figure 2:
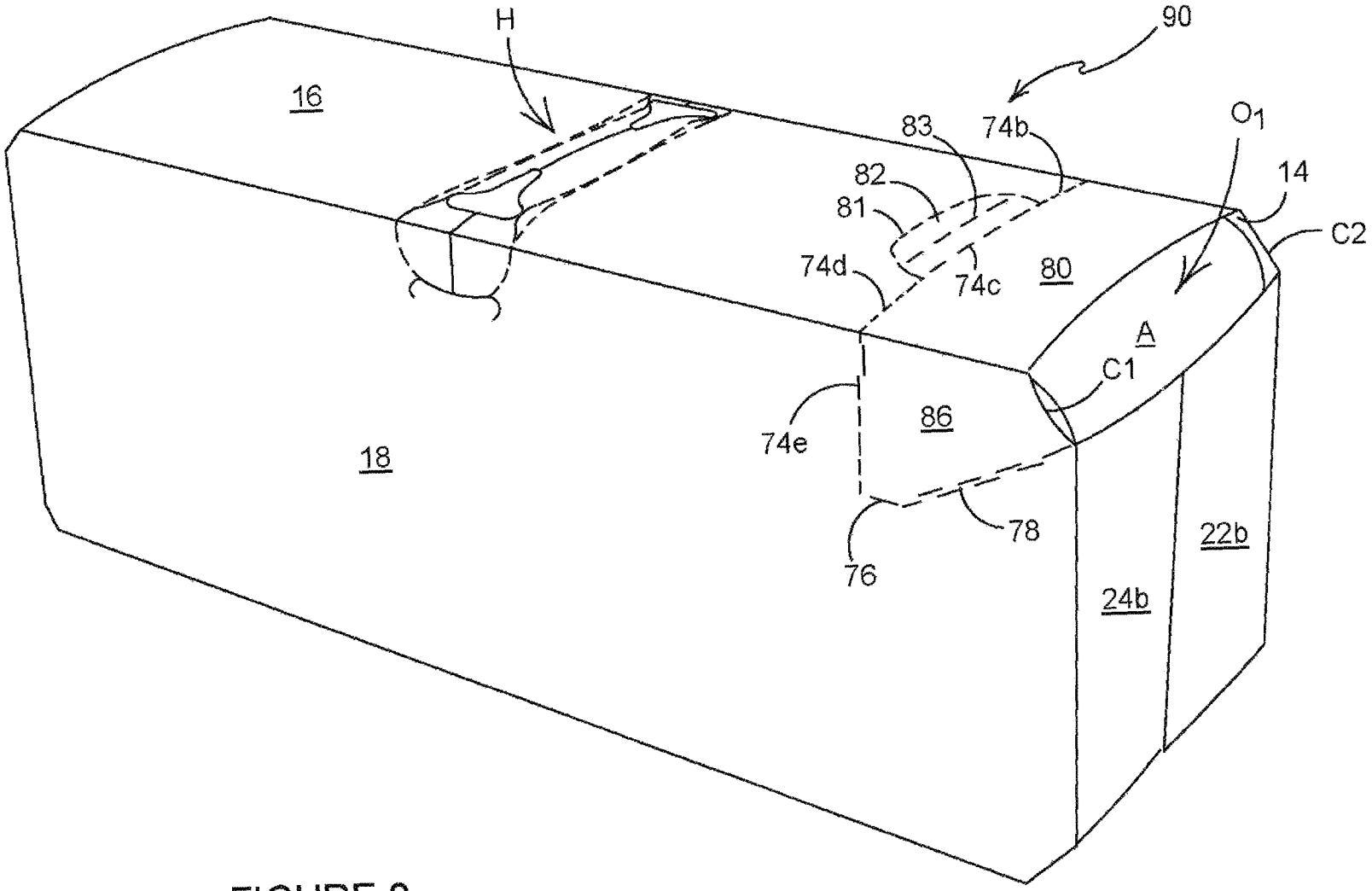
FIG. 2 is a perspective view from above of a carton formed from the blank of FIG. 1.

Referring to FIGS. 1 and 2 there is shown a blank 10 for forming a carton 90 capable of accepting an input of primary products such as, but not limited to, bottles or cans, hereinafter referred to as articles A.

The blank 10 comprises a plurality of main panels 12, 14, 16, 18, 20, hinged one to the next in a linear series. A base panel 12 is hinged to a first side wall panel 14 by a hinged connection such as a fold line 13. First side wall panel 14 is hinged to a top panel 16 by a hinged connection such as a fold line 15. Top panel 16 is hinged to second side wall panel 18 by a hinged connection such as a fold line 17. Second side wall panel 18 is hinged to glue panel 20 by a hinged connection such as a fold line 19.

Top panel 16 comprises a carrying handle H comprising first foldable flap 30 and a second foldable flap 32. The first foldable flap 30 is defined in part by first a hinged connection such as a fold line 37, a first aperture A1, a second aperture A2 and by a first cutline or severance line 31*b*. The second foldable flap 32 is defined in part by a second fold line 41, the first aperture A1, the second aperture A2 and by the cutline or severance line 31*b*.

The carrying handle H comprises a first tab 34*a* and a second tab 36*a* each of which is defined in part in the top panel 16 and in part in the first side wall panel 14. The carrying handle H comprises a third tab 34*b* and a fourth tab 36*b* each of which is defined in part in the top panel 16 and in part in the second side wall panel 18.

The first fold line 37 and the second fold line 41 each extend across the top panel 16 and into each of the first and second side wall panels 14, 18. Portions of the first fold line 37 define in part the first tab 34*a* and the third tab 34*b*. Portions of the second fold line 41 define in part the second tab 36*a* and the fourth tab 36*b*.

A second cutline or severance line 33*a* defines in part the first tab 34*a* and second tab 36*a*; the first tab 34*a* and second tab 36*a* are separated by a third cutline or severance line 31*a*. A fourth cutline or severance line 33*b* defines in part the third tab 34*b* and the fourth tab 36*b*; the third tab 34*b* and the fourth tab 36*b* are separated by a fifth cutline or severance line 31*c*.

Optionally, the second and fourth outlines 33*a*, 33*b* are arcuate in shape and each end thereof terminates in a "C" or "J" shaped section.

A third fold line 35 extends across the top panel 16. The third fold line 35 defines in part a first connecting portion which couples the first foldable flap 30 to the first tab 34*a* and a third connecting portion which couples the first foldable flap 30 to the third tab 34*b* .

A fourth fold line 39 extends across the top panel 16. The fourth fold line 39 defines in part a second connecting portion which couples the second foldable flap 32 to the second tab 36*a* and a fourth connecting portion which couples the second foldable flap 32 to the fourth tab 36*b*.

First aperture A1 separates the first foldable flap 30 from the first tab 34*a* and separates the second foldable flap 32 from the second tab 36*a*. First aperture A1 interrupts or intersects with the first fold line 37 and interrupts or intersects with the second fold line 41.

Second aperture A2 separates the first foldable flap 30 from the third tab 34*b* and separates the second foldable flap 32 from the fourth tab 36*b*. Second aperture A2 interrupts or intersects with the first fold line 37 and interrupts or intersects with the second fold line 41.

In alternative embodiments alternative handle structures may be employed.

The plurality of main panels 12, 14, 16, 18, 20 of the blank 10 form walls of an open ended tubular structure in a set-up condition. The tubular structure is at least partially closed by end closure structures. The tubular structure has a tubular axis defining a longitudinal direction.

Each of the ends of the tubular structure is at least partially closed by end closure panels, which form end walls of the tubular structure. In the illustrated embodiment the ends of the tubular structure are fully closed by end closure panels 22*a*, 24*a*, 22*b*, 24*b*.

End closure panels 22*a*, 24*a* are configured to close a first end of the tubular structure and end closure panels 22*b*, 24*b* are configured to close a second end of the tubular structure.

The first end of the tubular structure is closed by a first end closure panel 22*a* and a second end closure panel 24*a*. The first end closure panel 22*a* is hinged to a first end of the first side wall panel 14 by a hinged connection such as a fold line 21*a*. The second end closure panel 24*a* is hinged to a first end of the second side wall panel 18 by a hinged connection such as a fold line 23*a*. The second end of the tubular structure is closed by a third end closure panel 22*b* and a fourth end closure panel 24*b*. The third end closure panel 22*b* is hinged to a second end of the first side wall panel 14 by a hinged connection such as a fold line 21*b*. The fourth end closure panel 24*b* is hinged to a second end of the second side wall panel 18 by a hinged connection such as a fold line 23*b*.

The first and second side wall panels 14, 18 each have a longitudinal length dimension Y. The top panel 16 and the base panel 12 each have a longitudinal length dimension Z. Longitudinal length dimension Y is greater than the longitudinal length dimension Z.

Fold lines 13, 15, 17, 19 each have a length Z.

Optionally, the length of the fold line 13 is less than the length of the first side wall panel 14.

The length of the fold line 15 is less than the length of the first side wall panel 14.

The length of the fold line 17 is less than the length of the second side wall panel 18.

Optionally, the length of the fold line 19 is less than the length of the second side wall panel 18.

The first side wall panel 14 comprises cut away corners C2. The second side wall panel 18 comprises cut away corners C1. In the illustrated embodiment of FIG. 1 the corners are bevelled or chamfered. In other embodiments other shapes may be employed; for example, the corners may be arcuate and may optionally be shaped so as to be complimentary to the articles A disposed in the carton 90; the corners may be curved in shape and may have a radius of curvature similar to the cross section of the articles A.

In the illustrated embodiment the first side wall panel 14 comprises cut away corners C2 at both ends thereof. In alternative embodiments the first side wall panel 14 may comprise cut away corners C2 at only one end thereof. Optionally the cut away corners C2 may be provided at the same end of the blank 10 at which the dispenser D is provided.

In the illustrated embodiment the second side wall panel 18 comprises cut away corners C1 at both ends thereof. In alternative embodiments the second side wall panel 18 may comprise cut away corners C1 at only one end thereof. Optionally the cut away corners C1 may be provided at the same end of the blank 10 at which the dispenser D is provided.

The end closure panels 22*a*, 22*b*, 24*a*, 24*b* are configured to be shorter in height than the height of the respective first or second side wall panel 14, 18 to which they are hinged.

The fold lines 21*a*, 21*b*, 23*a*, 23*b* have a length dimension which is smaller than the height dimension of the respective one of the first or second side wall panels 14, 18. The upper edge of the end closure panel 22*b* is offset from the upper edge of the first side wall panel 14, defined by the fold line 13, by a distance X. The upper edge of the end closure panel 24*b* is offset from the upper edge of the second side wall panel 18, defined by the fold line 17, by a distance X.

The offset arrangement of the upper edges of the third and fourth end closure panels 22*b*, 24*b* in combination with the shortened arrangement of the top panel 16 with respect to the first and second side wall panels 14, 18, and the absence of an end closure panel hinged to the second end of the top panel 16, creates an opening $O_1$ (see FIG. 2) at an upper end of the carton 90. A portion of an endmost article A in an uppermost row of articles A is visible through the opening $O_1$.

The blank 10 comprises a dispenser D for facilitating access to the contents of the carton 90. The dispenser D comprises a removable corner portion of the carton 90. The dispenser D comprises a plurality of severance lines 70, 72, 74*a*, 74*b*, 81, 74*d*, 74*e*, 76, 78.

A first severance line 70 extends from fold line 21*b* into the first side wall panel 14. The first severance line 70 is arranged to be divergent with respect to the fold line 21*b*. The first severance line 70 extends from the upper corner C2 at the second end of the first side wall panel 14 substantially towards the opposing lower corner at the first end of the first side wall panel 14. A second severance line 72 extends from the first severance line 70 towards the first end of the first side wall 14. The second severance line 72 is arranged to be substantially parallel to the fold line 15. A third severance line 74*a* extends from the second severance line 72 to the fold line 15. The third severance line 74*a* is disposed substantially perpendicularly to the fold line 15. A fourth severance line 74*b* extends from the third severance line 74*a* transversely across a portion of the top panel 16. A fifth severance line 81 extends from the fourth severance line 74*b*. The fifth severance line 81 is substantially "U" shaped. A sixth severance line 74*d* extends from the fifth severance line 81 transversely across a portion of the top panel 16. The sixth severance line 74*d* is collinear with the fourth severance line 74*b*. The sixth severance line 74*d* intersects with the fold line 17 between the top panel 16 and the second side panel 18. The fourth severance line 74*b*, the fifth severance line 81 and the sixth severance line 74*d* together extend across the top panel 16. A seventh severance line 74*e* extends from the intersection of sixth severance line 74*d* with fold line 17 into the second side wall panel 18. The seventh severance line 74*e* is orientated substantially perpendicular to the fold line 17. An eighth severance line 76 extends from the seventh severance line 74*e* towards the second end of the second side wall 18. The eighth severance line 76 is arranged to be substantially parallel to the fold line 17. A ninth severance line 78 extends from fold line 23*b* into the second side wall panel 18. The ninth severance line 78 is arranged to be divergent with respect to the fold line 23*b*. The ninth severance line 78 extends from the upper corner C1 at the second end of the second side wall panel 18 substantially towards the opposing lower corner at the first end of the second side wall panel 18. The ninth severance line 78 intersects and terminates at an end of the eighth severance line 76 proximate the fold line 23*b*. In this way the plurality of severance lines 70, 72, 74*a*, 74*b*, 81, 74*d*, 74*e*, 76, 78 defines a continuous line of severance. The plurality of severance lines 70, 72, 74*a*, 74*b*, 81, 74*d*, 74*e*, 76, 78 define a detachable portion 84/80/86 of the carton 90. The detachable portion 84/80/86 comprises a first part 84 formed from a portion of the first side wall panel 14, a second part 80 formed from a portion of the top panel 16, and a third part 86 formed from a portion of the second side wall panel 18.

The dispenser D may comprise a tear initiation device in the form of a tab 82. The tab 82 is hingedly coupled to the detachable portion 84/80/86. The tab 82 is defined by the fifth severance line 81 and by a fold line 74*c* which couples the tab 82 to the second part 80 of the detachable portion 84/80/86. The tab 82 is struck from material forming the top panel 16. Optionally, the tab 82 may comprise a hinged connection such as a fold line 83 extending transversely thereacross. The fold line 74*c* is optionally arranged to be collinear with the fourth and sixth severance lines 74*b*, 74*d*.

Figure 3:
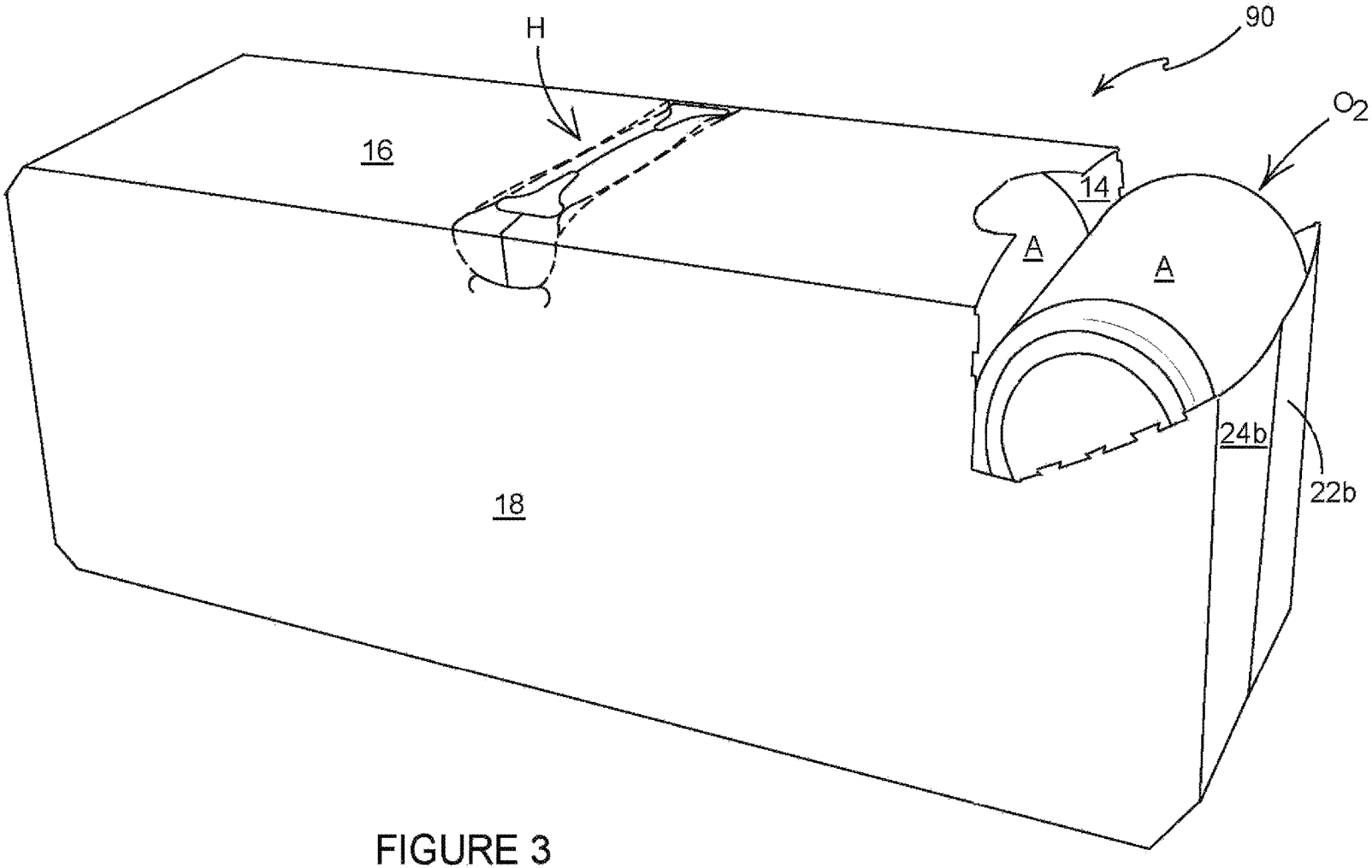
FIG. 3 is a perspective view from above of the carton of FIG. 2 in which a dispenser has been deployed.

Turning to the construction of the carton 90 as illustrated in FIGS. 2 and 3, the carton 90 can be formed by a series of sequential folding operations in a straight line machine so that the carton 90 is not required to be rotated or inverted to complete its construction. The folding process is not limited to that described below and may be altered according to particular manufacturing requirements.

The blank 10 is folded about fold line 17 such that the second side wall panel 18 is brought into face contacting relationship with the top panel 16 and the glue panel 20 is brought into face contacting relationship with the first side wall panel 14.

Glue or other adhesive treatment is applied to the glue panel 20 or, in alternative embodiments, to a corresponding portion of the base panel 12.

The blank 10 is folded about fold line 13 such that the base panel 12 is brought into face contacting relationship with an inside surface of the glue panel 20 and overlies the first side wall panel 14. The base panel 12 is secured to the glue panel 20. In this way a flat collapsed carton is formed. The carton 90 may be shipped or distributed in this flat collapsed form.

In alternative embodiments the base panel 12 may be secured to the glue panel 20 by alternative securing means for example, but not limited to, staples or other mechanical fixing means.

The flat collapsed carton may be erected into a tubular structure by separating the top panel 16 from the base panel 12.

The carton 90, in its open ended tubular form, may be loaded with articles A through one or both open ends. It will be appreciated that in other embodiments one of the open ends of the carton 90 may be closed before loading the carton 90 with articles A through the remaining open end.

In some embodiments, some or all of the end closure panels 22*a*, 24*a*, 22*b*, 24*b* may be folded outwardly so as to create a funnel at the open end of the tubular structure for facilitating loading of the carton 90 with articles A.

Once the carton 90 is loaded with articles A the ends of the tubular structure are closed.

A first end of the tubular structure is closed by folding the first end closure panel 22*a* about fold line 21*a*.

Glue or other adhesive treatment may be applied to an outer surface of the first end closure panel 22*a* or, in alternative embodiments, to a corresponding portion of an inner surface of the second end closure panel 24*a*.

The second end closure panel 24*a* is then folded about the fold line 23*a* to be brought into contact with the first end closure panel 22*a* and is secured thereto.

A second end of the tubular structure is closed by folding the third end closure panel 22*b* about the fold line 21*b*.

Glue or other adhesive treatment may be applied to an outer surface of the third end closure panel 22*b* or, in alternative embodiments, to a corresponding portion of an inner surface of the fourth end closure panel 24*b*.

The fourth end closure panel 24*b* is then folded about the fold line 23*b* to be brought into contact with the third end closure panel 22*b* and is secured thereto.

FIGS. 2 and 3 illustrate the assembled carton 90 forming a package with a plurality of articles A.

Referring to FIGS. 2 and 3 the carton 90 comprises dispenser D disposed in part in the top panel 16 and in part in the first and second side wall panels 14, 18. The carton 90 comprises an opening $O_1$ disposed adjacent to the dispenser D. The opening $O_1$ is defined in part by the second end edge of the top panel 16 and an upper edge of each of the third and fourth end closure panels 22*b*, 24*b*.

As shown in FIG. 3, when the detachable portion 84/80/86 is removed the opening $O_1$ is increased in size to form a second opening $O_2$. The second opening $O_2$ is dimensioned such that an article A can be removed therethrough, whereas the dimension of the opening $O_1$ is sufficiently small such that the article A cannot be withdrawn from the carton 90.

Figure 4:
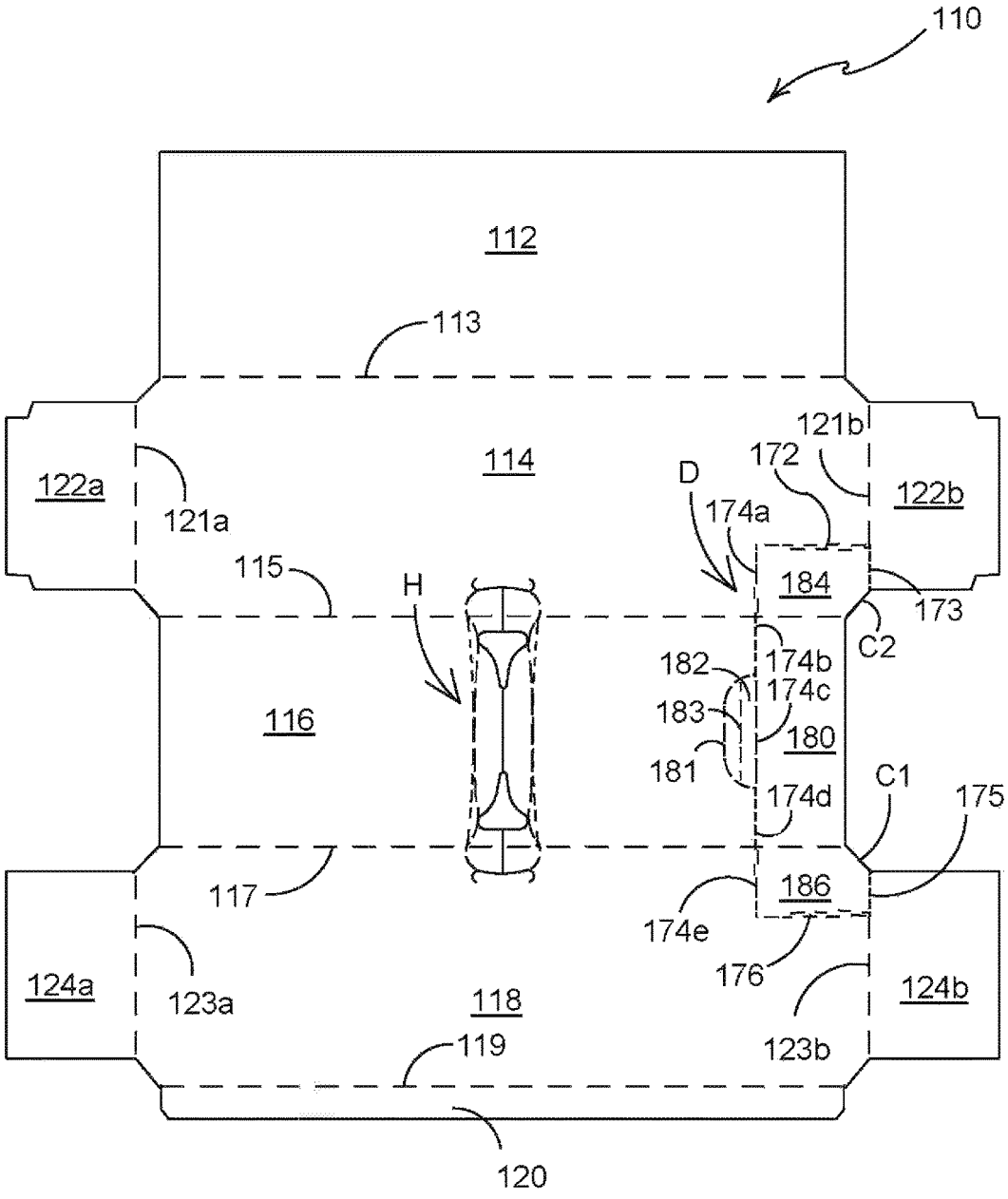
FIG. 4 is a plan view from above of a blank for forming a carton according to a second embodiment of the invention.
Figure 5:
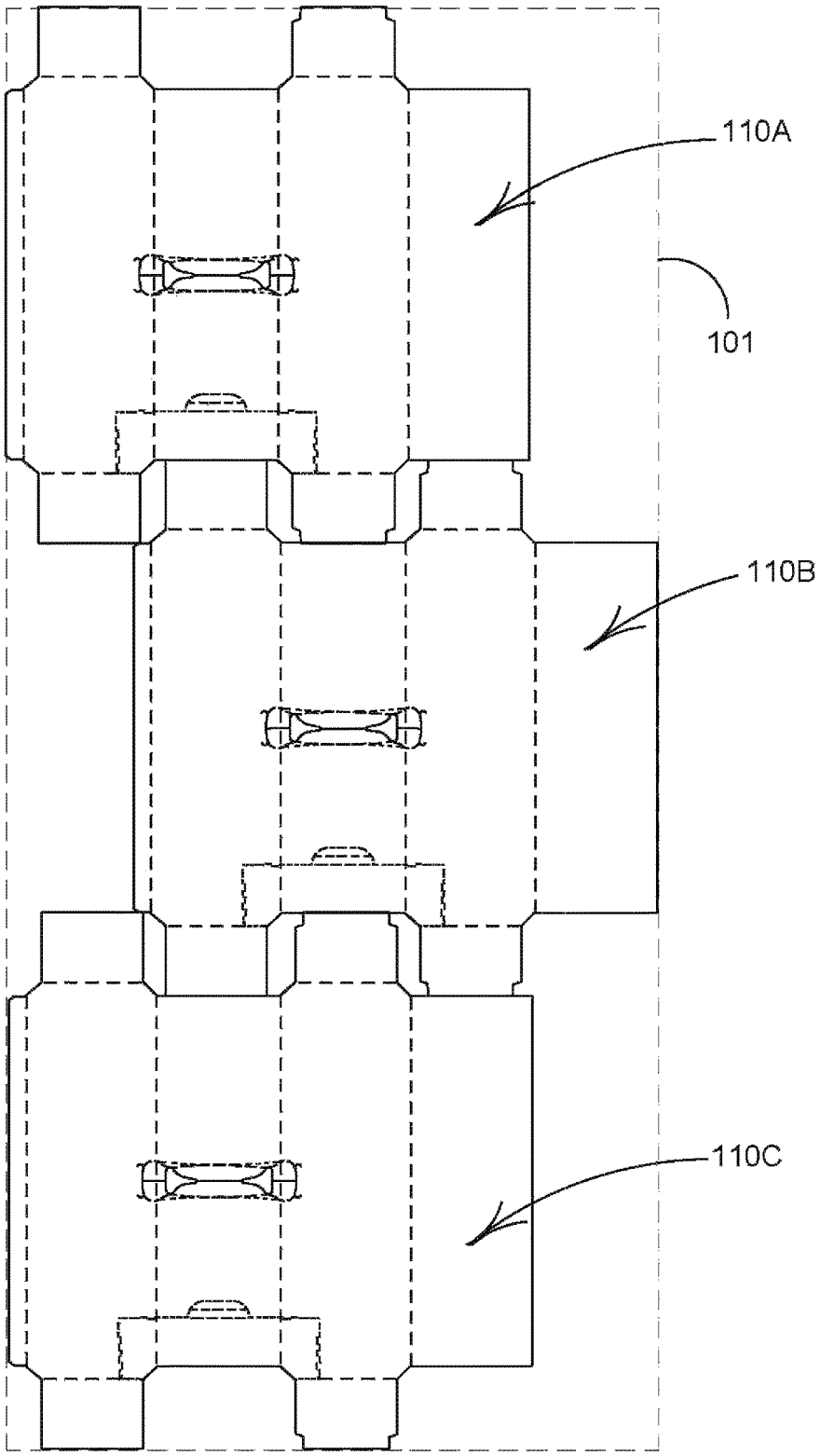
FIG. 5 is a plan view from above of a sheet of material having a plurality of the blanks of FIG. 4 struck therefrom.

Referring now to FIGS. 4 and 5, there is shown an additional embodiment of the present disclosure. In the second illustrated embodiment, like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 3 will be described in detail.

The blank 110 comprises a plurality of main panels 112, 114, 116, 118, 120 hinged one to the next in a linear series. A base panel 112 is hinged to a first side wall panel 114 by a hinged connection such as a fold line 113. First side wall panel 114 is hinged to a top panel 116 by a hinged connection such as a fold line 115. Top panel 116 is hinged to second side wall panel 118 by a hinged connection such as a fold line 117. Second side wall panel 118 is hinged to glue panel 120 by a hinged connection such as a fold line 119.

Top panel 116 comprises a carrying handle H comprising first foldable flap and a second foldable flap.

The plurality of main panels 112, 114, 116, 118, 120 of the blank 110 form walls of an open ended tubular structure in a set-up condition. The tubular structure is at least partially closed by end closure structures. The tubular structure has a tubular axis defining a longitudinal direction.

Each of the ends of the tubular structure is at least partially closed by end closure panels, which form end walls of the tubular structure. In the illustrated embodiment the ends of the tubular structure are fully closed by end closure panels 122*a*, 124*a*, 122*b*, 124*b*.

End closure panels 122*a*, 124*a* are configured to close a first end of the tubular structure and end closure panels 122*b*, 124*b* are configured to close a second end of the tubular structure.

The first end of the tubular structure is closed by a first end closure panel 122*a* and a second end closure panel 124*a*. The first end closure panel 122*a* is hinged to a first end of the first side wall panel 114 by a hinged connection such as a fold line 121*a*. The second end closure panel 124*a* is hinged to a first end of the second side wall panel 118 by a hinged connection such as a fold line 123*a*. The second end of the tubular structure is closed by a third end closure panel 122*b* and a fourth end closure panel 124*b*. The third end closure panel 122*b* is hinged to a second end of the first side wall panel 114 by a hinged connection such as a fold line 121*b*. The fourth end closure panel 124*b* is hinged to a second end of the second side wall panel 118 by a hinged connection such as a fold line 123*b*.

The blank 110 comprises a dispenser D for facilitating access to the contents of a carton (not shown). The dispenser D comprises a removable corner portion of the carton. The dispenser D comprises a plurality of severance lines 172, 173, 174*a*, 174*b*, 181, 174*d*, 174*e*, 175, 176.

A first severance line 173 extends along the fold line 121*b* from an upper edge of the third end closure panel 122*b*. The first severance line 173 is arranged to be collinear with the fold line 121*b*. The first severance line 173 extends from the upper corner C2 at the second end of the first side wall panel 114 substantially towards the adjacent lower corner at the second end of the first side wall panel 114. A second severance line 172 extends from the first severance line 173 towards the first end of the first side wall 114. The second severance line 172 is arranged to be substantially parallel to the fold line 115. A third severance line 174*a* extends from the second severance line 172 to the fold line 115. The third severance line 174*a* is disposed substantially perpendicularly to the fold line 115. A fourth severance line 174*b* extends from the third severance line 174*a* transversely across a portion of the top panel 116. A fifth severance line 181 extends from the fourth severance line 174*b*. The fifth severance line 181 is substantially "U" shaped. A sixth severance line 174*d* extends from the fifth severance line 181 transversely across a portion of the top panel 116. The sixth severance line 174*d* is collinear with the fourth severance line 174*b*. The sixth severance line 174*d* intersects with the fold line 117 between the top panel 116 and the second side panel 118. The fourth severance line 174*b*, fifth severance line 181, sixth severance line 174*d* together extend across the top panel 116. A seventh severance line 174*e* extends from the intersection of the sixth severance line 174*d* with the fold line 117 into the second side wall panel 118. The seventh severance line 174*e* is orientated substantially perpendicular to the fold line 117. An eighth severance line 176 extends from the seventh severance line 174*e* towards the second end of the second side wall 118. The eighth severance line 176 is arranged to be substantially parallel to the fold line 117. A ninth severance line 175 extends along fold line 123*b* from an upper edge of the fourth end closure panel 124*b*. The ninth severance line 175 is arranged to be collinear with the fold line 123*b*. The ninth severance line 175 extends from the upper corner C1 at the second end of the second side wall panel 118 substantially towards the adjacent lower corner at the second end of the second side wall panel 118. The ninth severance line 175 intersects with, and terminates at, an end of the eighth severance line 176 on the fold line 123*b*. In this way the plurality of severance lines 172, 173, 174*a*, 174*b*, 181, 174*d*, 174*e*, 175, 176 define a continuous line of severance. The plurality of severance lines 172, 173, 174*a*, 174*b*, 181, 174*d*, 174*e*, 175, 176 defines a detachable portion 184/180/186 of the carton. The detachable portion 184/180/186 comprises a first part 184 formed from a portion of the first side wall panel 114, a second part 180 formed from a portion of the top panel 116, and a third part 186 formed from a portion of the second side wall panel 118.

The dispenser D may comprise a tear initiation device in the form of a tab 182. The tab 182 is hingedly coupled to the detachable portion 184/180/186. The tab 182 is defined by the fifth severance line 181 and by a fold line 174*c* which couples the tab 182 to the second part 180 of the detachable portion 184/180/186. The tab 182 is struck from material forming the top panel 116. Optionally, the tab 182 may comprise a hinged connection such as a fold line 183 extending transversely thereacross. The fold line 174*c* is optionally arranged to be collinear with the fourth and sixth severance lines 174*b*, 174*d*.

FIG. 5 illustrates a sheet of material 101 from which a plurality of blanks 110A, 110B, 110C are struck. The plurality of blanks 110A, 110B, 110C are nested with one another so as to reduce the quantity of sheet material required. The third end closure panel 122*b* of the first blank 110A is disposed between the first and second end closure panels 122*a*, 124*a* of the second blank 110B. The second end closure panel 122*a* of second blank 110B is disposed between the third and fourth end closure panels 122*b*, 124*b* of the first blank 110A.

The first end closure panel 122*a* of the third blank 110C is disposed between the third and fourth end closure panels 122*b*, 124*b* of the second blank 110B. The fourth end closure panel 124*b* of the second blank 110B is disposed between the first and second end closure panels 122*a*, 124*a* of the third blank 110C.

Thus it will be appreciated that by only providing end closure panels hinged to the first and second side wall panels 114, 118 the plurality of blanks 110A, 110B, 110C can be nested in an efficient manner. In alternative embodiments end closure panels may be provided hinged to the top panel 116 and base panel 112 only, allowing the plurality of blanks 110A, 110B, 110C to be nested in a similar manner.

Figure 6:
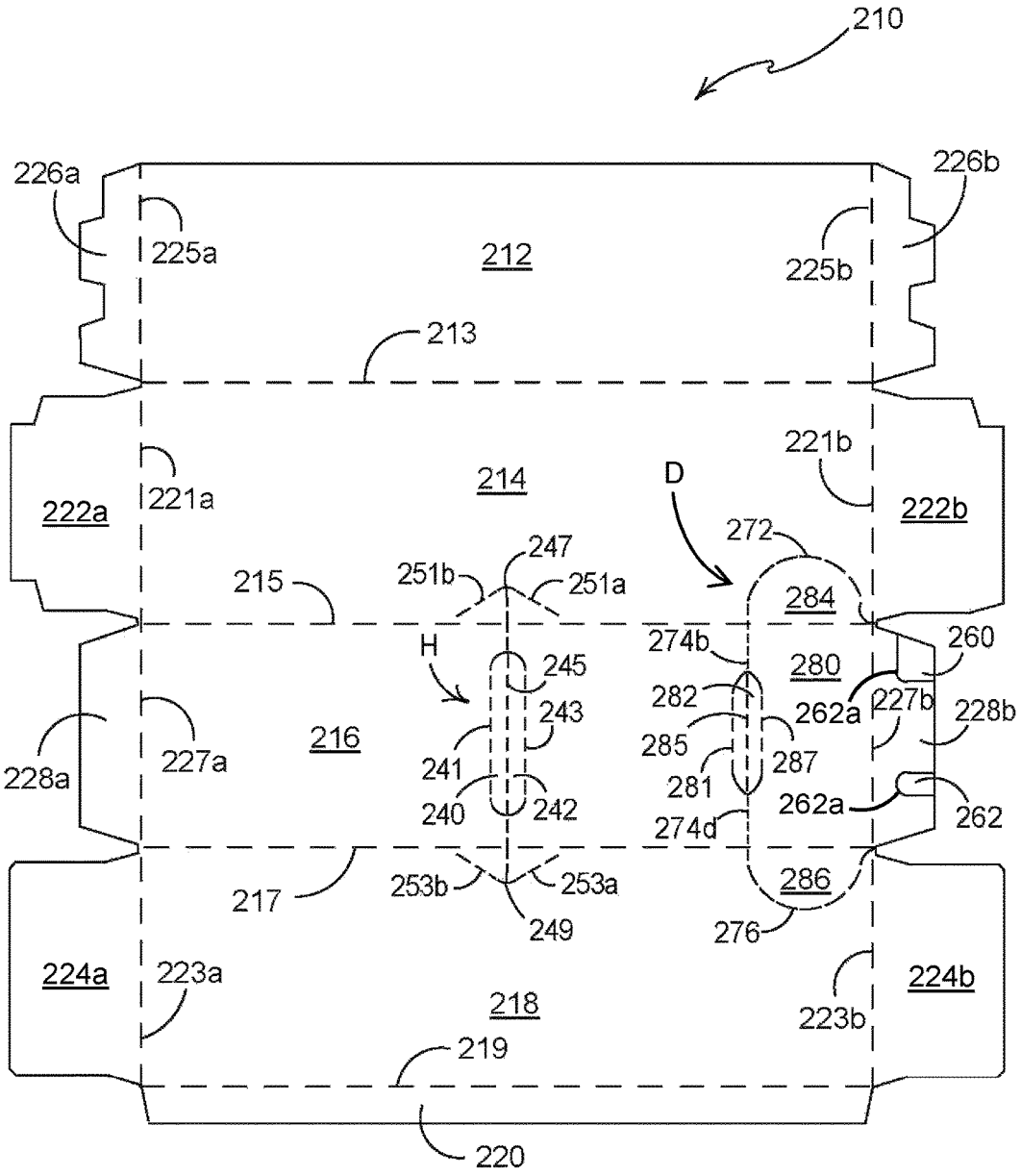
FIG. 6 is a plan view from above of a blank for forming a carton according to a third embodiment of the invention.
Figure 7:
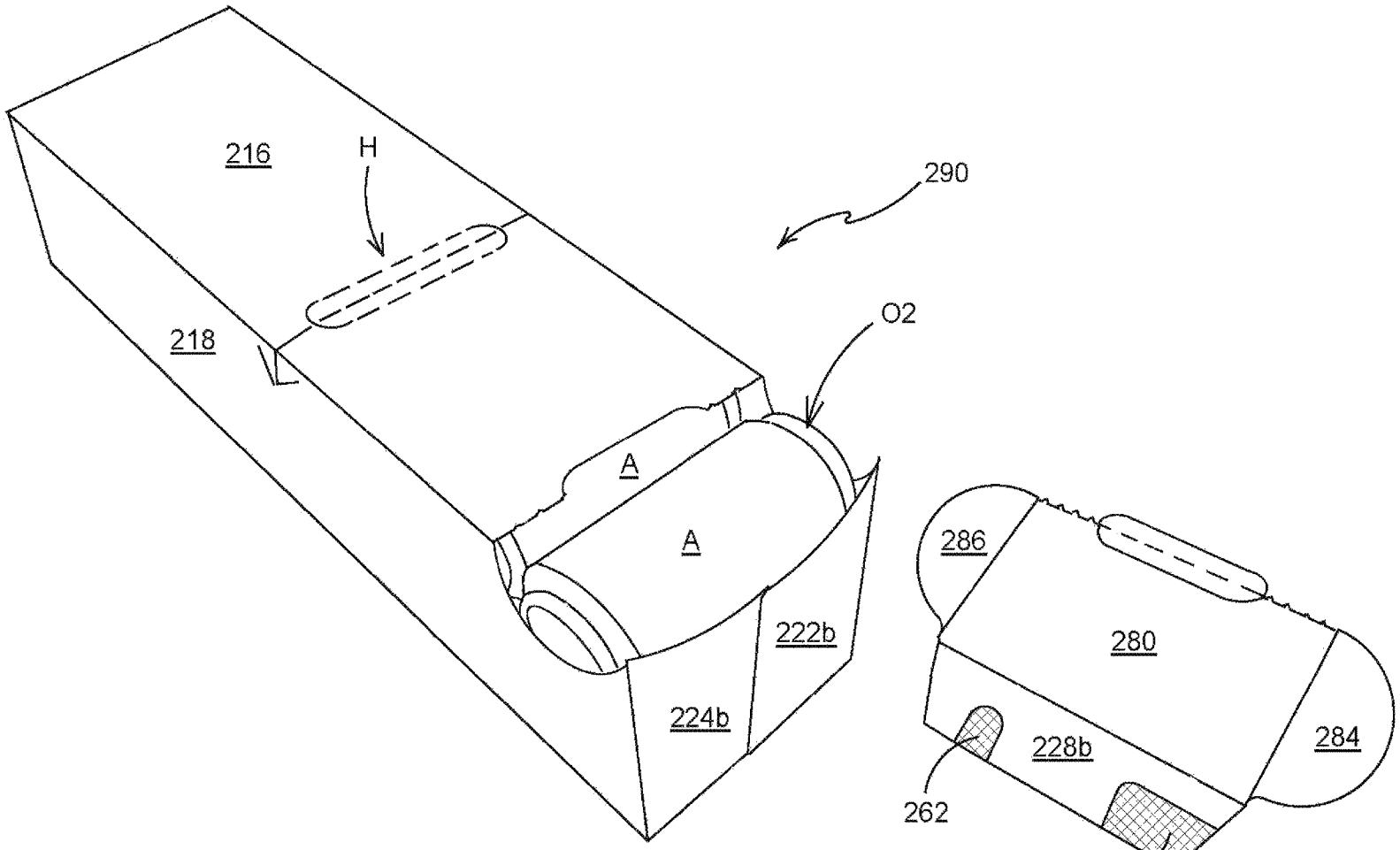
FIG. 7 is a perspective view from above of a carton formed from the blank of FIG. 6 in which a dispenser has been deployed.

Referring now to FIGS. 6 and 7, there is shown an additional embodiment of the present disclosure. In the third illustrated embodiment, like numerals have, where possible, been used to denote like parts, albeit with the addition of the prefix "200" to indicate that these features belong to the third embodiment. The additional embodiment shares many common features with the first and second embodiments and therefore only the differences from the embodiments illustrated in FIGS. 1 to 5 will be described in detail.

The blank 210 comprises a plurality of main panels 212, 214, 216, 218, 220 hinged one to the next in a linear series. A base panel 212 is hinged to a first side wall panel 214 by a hinged connection such as a fold line 213. First side wall panel 214 is hinged to a top panel 216 by a hinged connection such as a fold line 215. Top panel 216 is hinged to second side wall panel 218 by a hinged connection such as a fold line 217. Second side wall panel 218 is hinged to glue panel 220 by a hinged connection such as a fold line 219.

Top panel 216 comprises a carrying handle H which comprises a pair of elongate tabs 240, 242 which are defined in part by a severance line 245. The severance line 245 extends transversely across the top wall panel 216 and into each of the first and second side wall panels 214, 218. A first elongate tab 240 is defined in part by a first fold line 241, which is disposed in a spaced apart parallel relationship to the severance line 245. A second elongate tab 242 is defined in part by a second fold line 243 which is disposed in a spaced apart parallel relationship to the severance line 245. The first and second fold lines 241, 243 are disposed on opposing sides of the severance line 245. A first arcuate cutline defines the first ends of each of the first and second elongate tabs 240, 242. The first arcuate cutline extends between a first end of the first fold line 241 and a first end of the second fold line 243, across the severance line 245. A second arcuate cutline defines second ends of each of the first and second elongate tabs 240, 242. The second arcuate cutline extends between a second end of the first fold line 241 and a second end of the second fold line 243, across the severance line 245.

The handle structure H comprises a pair of fold or crease lines 251*a*, 251*b* at a first end of the line of severance 245. The first end of the severance line 245 is disposed in the first side wall panel 214 and terminates in a "V" shaped cutline 247 wherein each of the arms of the "V" shaped cutline 247 form a vertex, the vertex being disposed at the first end of the severance line 245. The pair of fold or crease lines 251*a*, 251*b* comprises a first crease line 251*a* and a second crease line 251*b*; the first and second crease lines 251*a*, 251*b* are formed continuously with the "V" shaped cutline 247 from opposing ends thereof.

The handle structure H comprises a second pair of fold or crease lines 253*a*, 253*b* at a second end of line of severance 245. The second end of the severance line 245 is disposed in the second side wall panel 218 and terminates in a "V" shaped cutline 249 wherein each of the arms of the "V" shaped cutline 249 form a vertex, the vertex being disposed at the second end of the severance line 245. The second pair of fold or crease lines 253*a*, 253*b* comprise a third crease line 253*a* and a fourth crease line 253*b*; the third and fourth crease lines 253*a*, 253*b* are formed continuously with the "V" shaped cutline 249 from opposing ends thereof.

The plurality of main panels 212, 214, 216, 218, 220 of the blank 210 form walls of an open ended tubular structure in a set-up condition. The tubular structure is at least partially closed by end closure structures. The tubular structure has a tubular axis defining a longitudinal direction.

Each of the ends of the tubular structure is at least partially closed by end closure panels, which form end walls of the tubular structure. In the illustrated embodiment the ends of the tubular structure are fully closed by end closure panels 222*a*, 224*a*, 226*a*, 228*a*, 222*b*, 224*b*, 226*b*, 228*b*.

End closure panels 222*a*, 224*a*, 226*a*, 228*a* are configured to close a first end of the tubular structure and end panels 222*b*, 224*b*, 226*b*, 228*b* are configured to close a second end of the tubular structure.

The first end of the tubular structure is closed by a first end closure panel 222*a*, a second end closure panel 224*a*, a third end closure panel 226*a* and a fourth end closure panel 228*a*. The first end closure panel 222*a* is hinged to a first end of the first side wall panel 214 by a hinged connection such as a fold line 221*a*. The second end closure panel 224*a* is hinged to a first end of the second side wall panel 218 by a hinged connection such as a fold line 223*a*. The third end closure panel 226*a* is hinged to a first end of the base panel 212 by a hinged connection such as a fold line 225*a*. The fourth end closure panel 228*a* is hinged to a first end of the top panel 216 by a hinged connection such as a fold line 227*a*.

The second end of the tubular structure is closed by a fifth end closure panel 222*b*, a sixth end closure panel 224*b*, a seventh end closure panel 226*b* and an eighth end closure panel 228*b*. The fifth end closure panel 222*b* is hinged to a second end of the first side wall panel 214 by a hinged connection such as a fold line 221*b*. The sixth end closure panel 224*b* is hinged to a second end of the second side wall panel 218 by a hinged connection such as a fold line 223*b*. The seventh end closure panel 226*b* is hinged to a second end of the base panel 212 by a hinged connection such as a fold line 225*b*. The eighth end closure panel 228*b* is hinged to a second end of the top panel 216 by a hinged connection such as a fold line 227*b*.

The first and second side wall panels 214, 218 have a longitudinal linear dimension which is substantially equal to a longitudinal linear dimension of the top panel 216 and the base panel 212.

Fold line 213 extends between fold line 225*a* and fold line 225*b*. Fold line 215 extends between fold line 221*a* and fold line 221*b*; fold line 217 extends between fold line 227*a* and fold line 227*b*; and fold line 219 extends between fold line 223*a* and fold line 223*b*.

The blank 210 comprises a dispenser D for facilitating access to the contents of a carton 290. The dispenser D comprises a removable corner portion of the carton. The dispenser D comprises a plurality of severance lines 272, 274*b*, 281, 274*d*, 276.

A first severance line 272 extends from a vertex between fold line 221*b* and fold line 215 into the first side wall panel 214. The first severance line 272 is arcuate or curved in shape.

Optionally the first severance line 272 is substantially "U" shaped or semi-circular. The first severance line 272 intersects the fold line 215 distal from the vertex between fold line 221*b* and fold line 215. The first severance line 272, together with the fold line 215, defines a first part 284 of a detachable portion 284/280/286.

A second severance line 274*b* extends from the first severance line 272 transversely across a portion of the top panel 216. A third severance line 281 extends from the second severance line 274*b*. The third severance line 281 is substantially "U" shaped. A fourth severance line 274*d* extends from the third severance line 281 transversely across a portion of the top panel 216. The fourth severance line 274*d* is collinear with the second severance line 274*b*. The fourth severance line 274*d* intersects with the fold line 217 between the top panel 216 and the second side panel 218. The second severance line 274*b*, third severance line 281 and fourth severance line 274*d* together extend across the top panel 216. The second severance line 274*b*, third severance line 281 and fourth severance line 274*d* together define a second part 280 of the detachable portion 284/280/286. A fifth severance line 276 extends from the intersection of fourth severance line 274*d* with fold line 217 into the second side wall panel 218. The fifth severance line 276 extends through the second side wall panel 218 to a vertex between fold line 223*b* and fold line 217. The fifth severance line 276 is arcuate or curved in shape; optionally the fifth severance line 276 is substantially "U" shaped or semi-circular. The fifth severance line 276, together with the fold line 217, defines a third part 286 of a detachable portion 284/280/286.

In this way the plurality of severance lines 272, 274*b*, 281, 274*d*, 276 defines a continuous line of severance. The plurality of severance lines 272, 274*b*, 281, 274*d*, 276 defines at least in part the detachable portion 284/280/286 of the carton. The detachable portion 284/280/286 comprises the first part 284 formed from a portion of the first side wall panel 214, the second part 280 formed from a portion of the top panel 216 and the third part 286 formed from a portion of the second side wall panel 218.

The dispenser D may comprise a tear initiation device in the form of a tab 282. The tab 282 is hingedly coupled to the detachable portion 284/280/286. The tab 282 is defined by the third severance line 281 and by a fold line 287 which couples the tab 282 to the second part 280 of the detachable portion 284/280/286. The tab 282 is struck from material forming the top panel 216. Optionally, the tab 282 may comprise a fold line 285 extending transversely thereacross. The fold line 285 is optionally arranged to be collinear with the second and fourth severance lines 274*b*, 274*d*.

The eighth end closure panel 228*b* is hingedly connected to the detachable portion 284/280/286 by fold line 227*b* and is configured to be removed along with the detachable portion 284/280/286 when the dispenser is deployed, as shown in FIG. 7.

The eighth end closure panel 228*b* comprises a first adhesive region 260 and a second adhesive region 262 for securing the eighth end closure panel 228*b* to the fifth end closure panel 222*b* and the sixth end closure panel 224*b* respectively. The material of the blank 210 forming first and second adhesive regions 260, 262 each comprises a weakened surface such that the eighth end closure panel 228*b* can be readily separated from the fifth end closure panel 222*b* and the sixth end closure panel 224*b* when the dispenser D is deployed. In this way the eighth end closure panel 228*b* can be easily detached from the carton 290 along with the detachable portion 284/280/286.

The first and second adhesive regions 260, 262 may be defined by severance lines 262*a*, 262*a*. The severance lines 262*a*, 262*a* allow the adhesive regions 260, 262 to become weakened regions that are separable at least in part from the eighth end closure panel 228 so that the weakened regions 260, 262 or their separated parts remain secured to the respective inside surfaces of the fifth and sixth end closure panels 222*b*, 224*b* when the removable corner portion 280 of the dispenser D is removed from the remainder of the carton 290. The severance lines 262*a*, 262*a* may be full-depth severance lines such as perforated lines or interrupted cut lines. Such full-depth severance lines allow the entire weakened regions 260, 262 to be separated from the eighth end closure panel 228 so that the weakened regions 260, 262 in their entireties may remain secured to the inside surfaces of the fifth and sixth end closure panels 222*b*, 224*b* respectively. Alternatively, the severance lines 262*a*, 262*a* may be partial depth cut lines or half-cut lines which are formed in the coated surface or otherwise outside surface of the eighth end closure panel 228*b*. Such partial-depth cut lines allow respective outside surface layers of the weakened regions 260, 262 to be pealed or separated from the remainder of the weakened regions 260, 262 so that the separated surface layers remain attached to the inside surfaces of the fifth and sixth end closure panels 222*b*, 224*b* respectively. In an alternative embodiment, the weakened regions may be defined in the fifth and sixth end closure panels 222*b*, 224*b* so that such weakened regions may be fully or partially separated from the fifth and sixth end closure panels 222*b*, 224*b* to remain attached to the outside surface of the eighth end closure panel 228*b*.

In other embodiments, the weakened regions 260, 262 may be provided in other ways; for example, the first adhesive region 260 and the second adhesive region 262 may be treated with a coating or additional layer or ply of material which reduces the bond strength between the eighth end closure panel 228*b* and the fifth and sixth end closure panels 222*b*, 224*b*. In other embodiments corresponding areas of the inner surface of the fifth and sixth end closure panels 222*b*, 224*b* may be weakened in addition to, or alternatively to, weakening the outer surface of the eighth end closure panel 228*b*.

Removal of the removable corner portion 280 from the carton 290 forms an opening O2, as shown in FIG. 7, through which articles A can be withdrawn.

Figure 8:
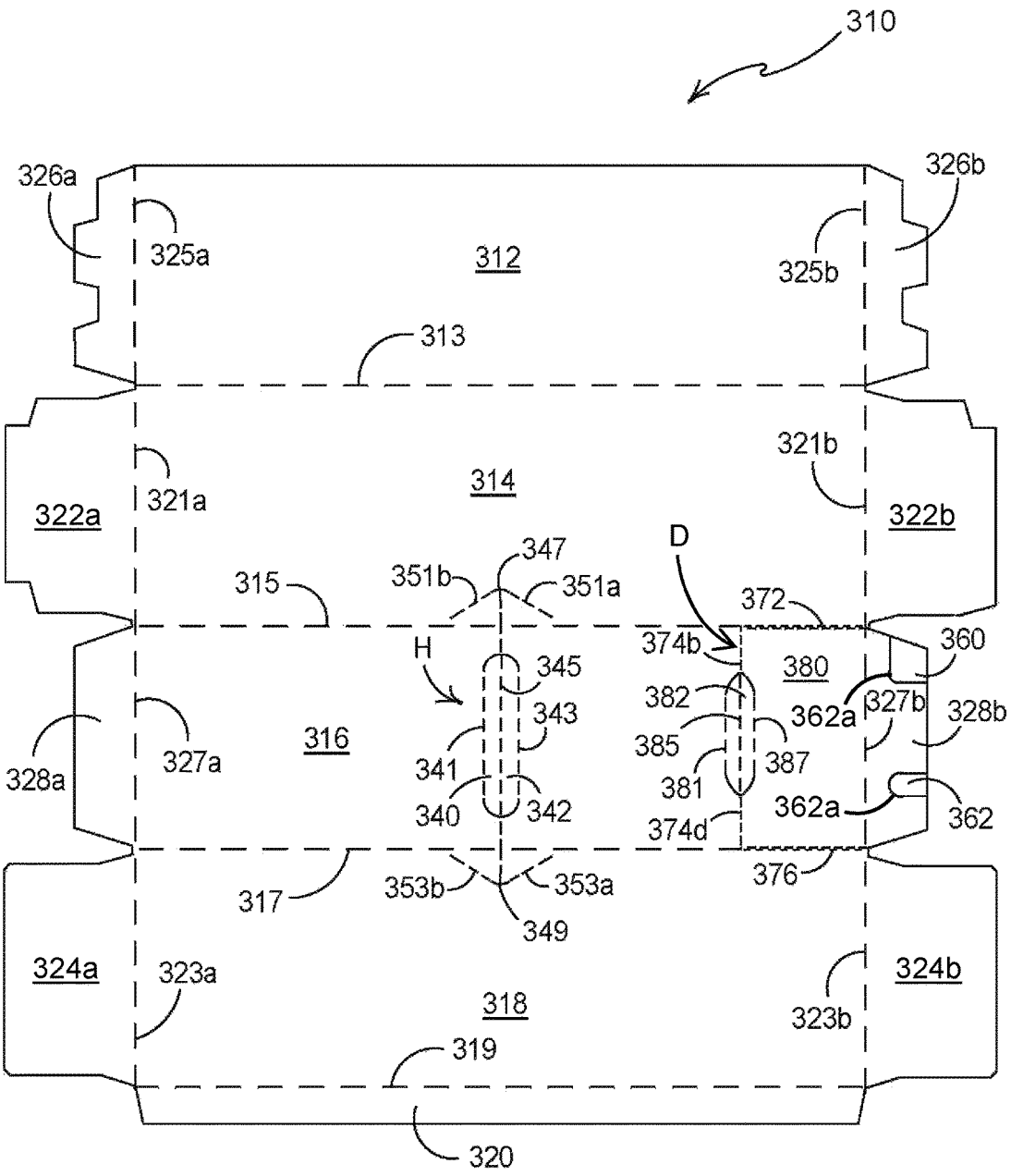
FIG. 8 is a plan view from above of a blank for forming a carton according to a fourth embodiment of the invention.
Figure 9:
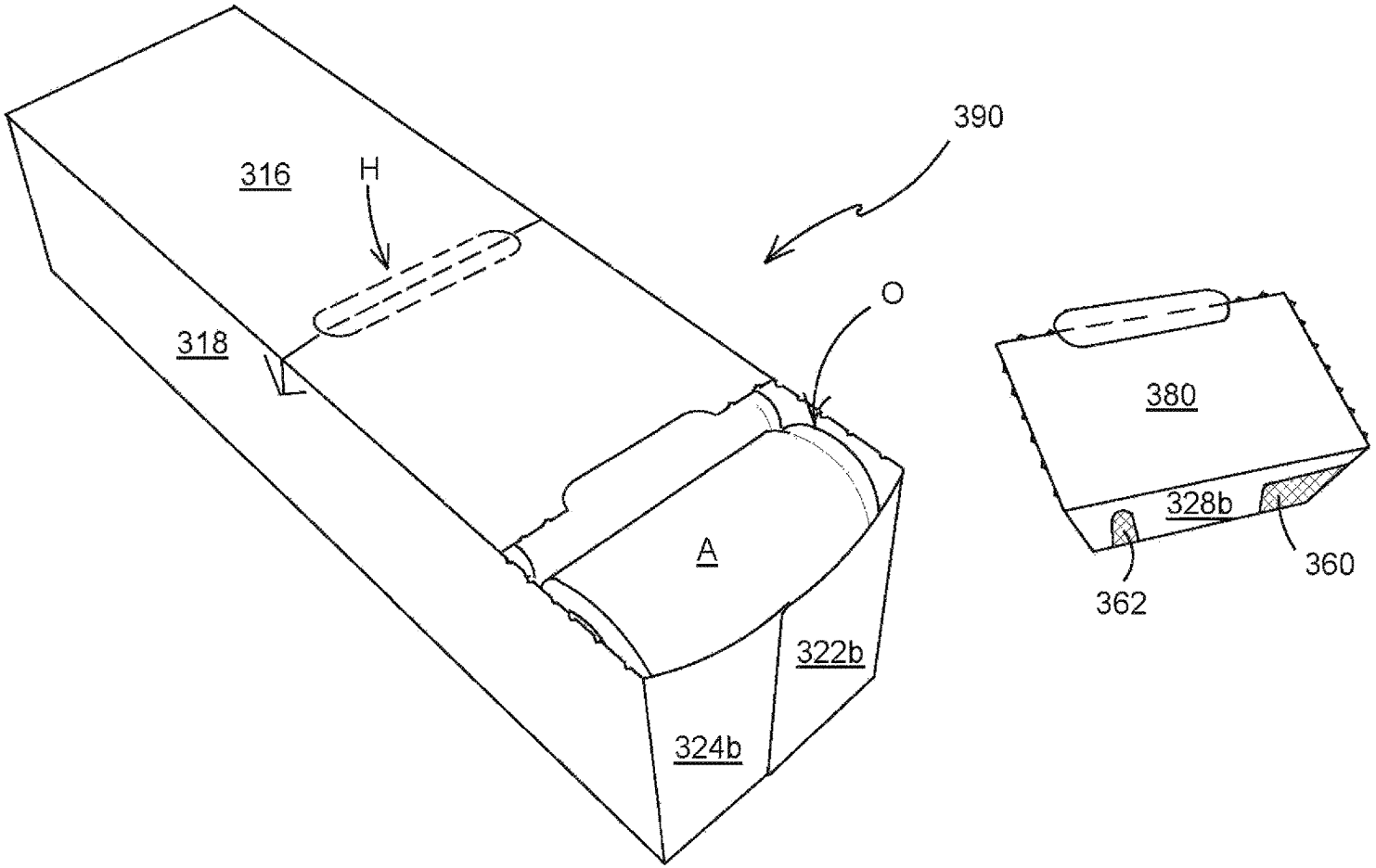
FIG. 9 is a perspective view from above of a carton formed from the blank of FIG. 8 in which a dispenser has been deployed.

Referring now to FIGS. 8 and 9, there is shown an additional embodiment of the present disclosure. In the fourth illustrated embodiment, like numerals have, where possible, been used to denote like parts, albeit with the addition of the prefix "300" to indicate that these features belong to the fourth embodiment. The additional embodiment shares many common features with the first, second and third embodiments and therefore only the differences from the embodiments illustrated in FIGS. 1 to 7 will be described in detail.

The blank 310 comprises a plurality of main panels 312, 314, 316, 318, 320 hinged one to the next in a linear series. A base panel 312 is hinged to a first side wall panel 314 by a hinged connection such as a fold line 313. A first side wall panel 314 is hinged to a top panel 316 by a hinged connection such as a fold line 315. A top panel 316 is hinged to a second side wall panel 318 by a hinged connection such as a fold line 317. The second side wall panel 318 is hinged to a glue panel 320 by a hinged connection such as a fold line 319.

The top panel 316 comprises a carrying handle H which comprises a pair of elongate tabs 340, 342.

The blank 310 comprises a dispenser D for facilitating access to the contents of a carton 390. The dispenser D comprises a removable corner portion of the carton. The dispenser D comprises a plurality of severance lines 372, 374*b*, 381, 374*d*, 376.

A first severance line 372 extends from a vertex between a hinged connection such as a fold line 321*b* and fold line 315 along the fold line 315. The first severance line 372 is linear and is arranged collinear with the fold line 315.

A second severance line 374*b* extends from the first severance line 372 transversely across a portion of the top panel 316. A third severance line 381 extends from the second severance line 374*b*. The third severance line 381 is substantially "U" shaped. A fourth severance line 374*d* extends from the third severance line 381 transversely across a portion of the top panel 316. The fourth severance line 374*d* is collinear with the second severance line 374*b*. The fourth severance line 374*d* intersects with the fold line 317 between the top panel 316 and the second side panel 318.

The second severance line 374*b*, third severance line 381 and fourth severance line 374*d* together extend across the top panel 316. A fifth severance line 376 extends from the intersection of fourth severance line 374*d* with fold line 317 along the fold line 317. The fifth severance line 376 is linear and is arranged collinear with the fold line 317.

The first severance line 372, second severance line 374*b*, third severance line 381, fourth severance line 374*d* and fifth severance line 376 together define a detachable portion 380 struck from material forming the top panel 316.

In this way the plurality of severance lines 372, 374*b*, 381, 374*d*, 376 defines a continuous line of severance. The plurality of severance lines 372, 374*b*, 381, 374*d*, 376 defines at least in part the detachable portion 380 of the carton 390.

The dispenser D may comprise a tear initiation device in the form of a tab 382. The tab 382 is hingedly coupled to the detachable portion 380. The tab 282 is defined by the third severance line 381 and by a fold line 387 which couples the tab 382 to the detachable portion 380. The tab 382 is struck from material forming the top panel 316. Optionally, the tab 382 may comprise a fold line 385 extending transversely thereacross. The fold line 385 is optionally arranged to be collinear with the second and fourth severance lines 374*b*, 374*d*.

The eighth end closure panel 328*b* is hingedly connected to the detachable portion 380 by a hinged connection such as a fold line 327*b* and is configured to be removed along with the detachable portion 380 when the dispenser is deployed, as shown in FIG. 9.

The eighth end closure panel 328*b* comprises a first adhesive region 360 and a second adhesive region 362 for securing the eighth end closure panel 328*b* to the fifth end closure panel 322*b* and the sixth end closure panel 324*b* respectively. The first and second adhesive regions 360, 362 each may comprise a weakened region defined, for example, by severance lines 360*a*, 362*a* such that eighth end closure panel 328*b* can be readily separated from the fifth end closure panel 322*b* and the sixth end closure panel 324*b* when the dispenser D is deployed. In this way the eighth end closure panel 328*b* can be easily detached from the carton 390 along with the detachable portion 380.

The surface of the eighth end closure panel 328*b* may be weakened in the first and second adhesive regions 360, 362 by providing the first and second adhesive regions 360, 362 with a plurality of partial depth cut lines. The partial depth cut lines may be arranged as a first series of parallel cuts and a second series of parallel cuts, the second series being arranged orthogonally with respect to the first series. In alternative embodiments other arrangements of partial depth cuts may be provided.

Removal of the detachable portion 380 from the carton 390 forms an opening O, as shown in FIG. 9, through which articles A can be withdrawn.

Figure 10:
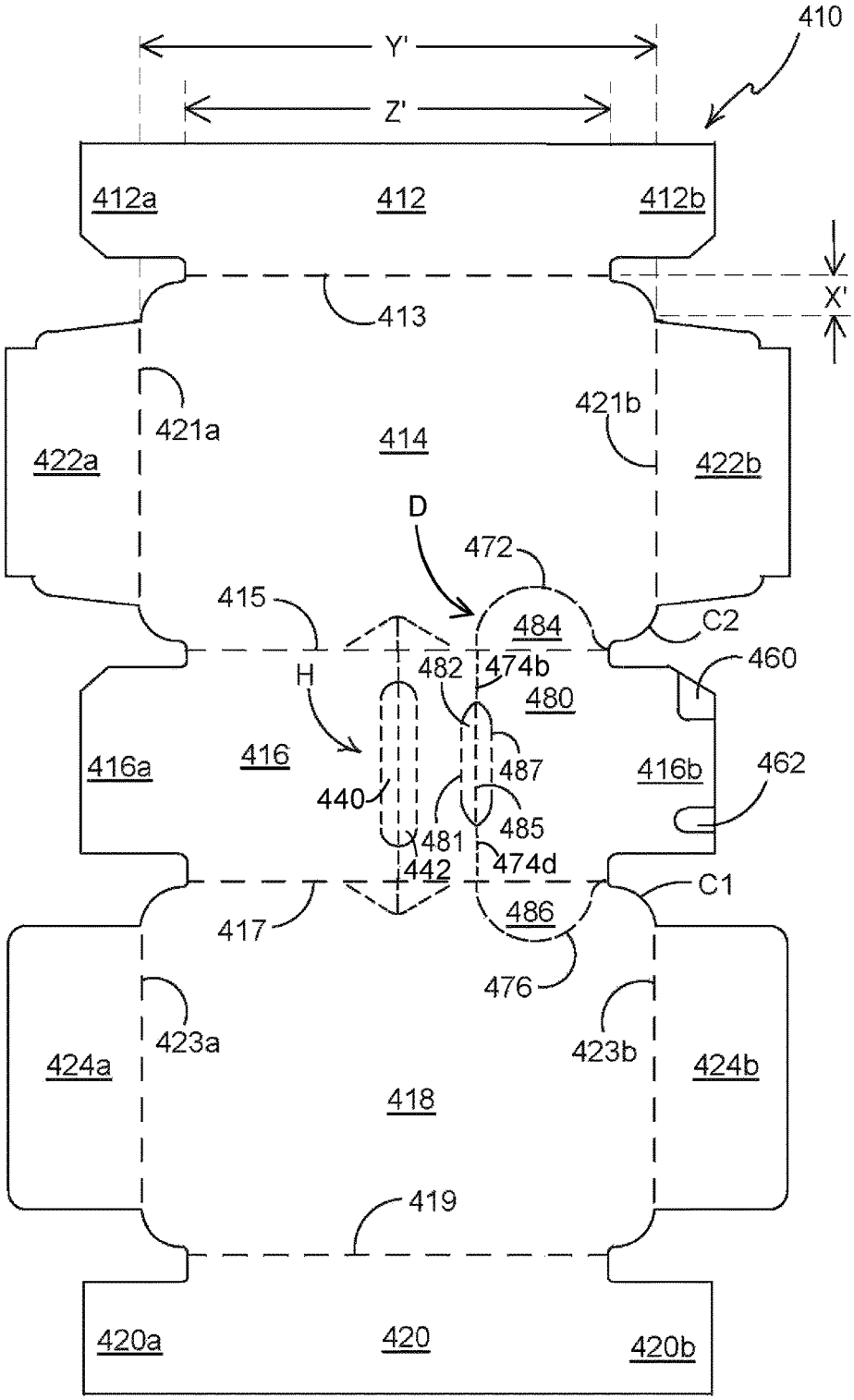
FIG. 10 is a plan view from above of a blank for forming a carton according to a fifth embodiment of the invention.

Referring now to FIG. 10, there is shown an additional embodiment of the present disclosure. In the fifth illustrated embodiment, like numerals have, where possible, been used to denote like parts, albeit with the addition of the prefix "400" to indicate that these features belong to the fifth embodiment. The additional embodiment shares many common features with the first, second, third and fourth embodiments and therefore only the differences from the embodiments illustrated in FIGS. 1 to 9 will be described in detail.

The blank 410 comprises a plurality of main panels 412, 414, 416, 418, 420 hinged one to the next in a linear series. A first base panel 412 is hinged to a first side wall panel 414 by a hinged connection such as a fold line 413. A first side wall panel 414 is hinged to a top panel 416 by a hinged connection such as a fold line 415. A top panel 416 is hinged to a second side wall panel 418 by a hinged connection such as a fold line 417. The second side wall panel 418 is hinged to a second base glue panel 420 by a hinged connection such as a fold line 419. The first base panel 412 and the second base panel 420 form a composite base panel 412,420 in a set up carton.

The top panel 416 comprises a carrying handle H which comprises a pair of elongate tabs 440, 442.

The blank 410 comprises a dispenser D for facilitating access to the contents of a carton (not shown). The dispenser D comprises a removable corner portion of the carton. The dispenser D comprises a plurality of severance lines 472, 474*b*, 481, 474*d*, 476.

A first severance line 472 extends from an end of fold line 415 at a first cut away corner C2 into the first side wall panel 414. The first severance line 472 is arcuate or curved in shape; optionally the first severance line 472 is substantially "U" shaped or semi-circular. The first severance line 472 intersects the fold line 415 distal from the first cut away corner C2. The first severance line 472, together with the fold line 415, defines a first part 484 of a detachable portion 484/480/486.

A second severance line 474*b* extends from the first severance line 472 transversely across a portion of the top panel 416. A third severance line 481 extends from the second severance line 474*b*. The third severance line 481 is substantially "U" shaped. A fourth severance line 474*d* extends from the third severance line 481 transversely across a portion of the top panel 416. The fourth severance line 474*d* is collinear with the second severance line 474*b*. The fourth severance line 474*d* intersects with the fold line 417 between the top panel 416 and the second side panel 418. The second severance line 474*b*, third severance line 481 and fourth severance line 474*d* together extend across the top panel 416. The second severance line 474*b*, third severance line 481 and fourth severance line 474*d* together define a second part 480 of the detachable portion 484/480/486. A fifth severance line 476 extends from the intersection of fourth severance line 474*d* with fold line 417 into the second side wall panel 418. The fifth severance line 476 extends through the second side wall panel 418 to a vertex between a hinged connection such as a fold line 423*b* and fold line 417. The fifth severance line 476 is arcuate or curved in shape; optionally the fifth severance line 476 is substantially "U" shaped or semi-circular. The fifth severance line 476, together with the fold line 417, defines a third part 486 of a detachable portion 484/480/486.

In this way the plurality of severance lines 472, 474*b*, 481, 474*d*, 476 defines a continuous line of severance. The plurality of severance lines 472, 474*b*, 481, 474*d*, 476 defines at least in part the detachable portion 484/480/486 of the carton. The detachable portion 484/480/486 comprises the first part 484 formed from a portion of the first side wall panel 414, the second part 480 formed from a portion of the top panel 416 and the third part 486 formed from a portion of the second side wall panel 418.

The dispenser D may comprise a tear initiation device in the form of a tab 482. The tab 482 is hingedly coupled to the detachable portion 484/480/486. The tab 482 is defined by the third severance line 481 and by a fold line 487 which couples the tab 482 to the second part 480 of the detachable portion 484/480/486. The tab 482 is struck from material forming the top panel 416. Optionally, the tab 482 may comprise a fold line 485 extending transversely thereacross.

The fold line 485 is optionally arranged to be collinear with the second and fourth severance lines 474*b*, 474*d*.

The plurality of main panels 412, 414, 416, 418, 420 of the blank 410 form walls of an open ended tubular structure in a set-up condition. The tubular structure is at least partially closed by end closure structures. The tubular structure has a tubular axis defining a longitudinal direction.

Each of the ends of the tubular structure is at least partially closed by end closure panels, which form end walls of the tubular structure. In the illustrated embodiment the ends of the tubular structure are fully closed by end closure panels 422*a*, 424*a*, 422*b*, 424*b*.

End closure panels 422*a*, 424*b* are configured to close a first end of the tubular structure and end closure panels 422*b*, 424*b* are configured to close a second end of the tubular structure.

The first end of the tubular structure is closed by a first end closure panel 422*a* and a second end closure panel 424*a*. The first end closure panel 422*a* is hinged to a first end of the first side wall panel 414 by a hinged connection such as a fold line 421*a*. The second end closure panel 424*a* is hinged to a first end of the second side wall panel 418 by a hinged connection such as a fold line 423*a*. The second end of the tubular structure is closed by a third end closure panel 422*b* and a fourth end closure panel 424*b*. The third end closure panel 422*b* is hinged to a second end of the first side wall panel 414 by a hinged connection such as a fold line 421*b*. The fourth end closure panel 424*b* is hinged to a second end of the second side wall panel 418 by a hinged connection such as a fold line 423*b*.

The first and second side wall panels 414, 418 each have a longitudinal length dimension Y'. The fold lines 413, 415, 417, 419 each have a longitudinal length dimension Z'. Longitudinal length dimension Y' is greater than the longitudinal length dimension Z'.

Optionally, the length of the fold line 413 is less than the length of the first side wall panel 414.

The length of the fold line 415 is less than the length of the first side wall panel 414.

The length of the fold line 417 is less than the length of the second side wall panel 418.

Optionally, the length of the fold line 419 is less than the length of the second side wall panel 418.

The first side wall panel 414 comprises cut away corners C2. The second side wall panel 418 comprises cut away corners C1. In the illustrated embodiment of FIG. 10 the corners are rounded or curved. In other embodiments other shapes may be employed, for example the corners may be bevelled or chamfered.

The end closure panels 422*a*, 422*b*, 424*a*, 422*b* are configured to be shorter in height than the height of the respective first or second side wall panel 414, 418 to which they are hinged.

The fold lines 421*a*, 421*b*, 423*a*, 423*b* have a length dimension which is smaller than the height dimension of the respective one of the first or second side wall panels 414, 418. The upper edge of the third end closure panel 422*b* is offset from the upper edge of the first side wall panel 414, defined by the fold line 413, by a distance X'. The upper edge of the fourth end closure panel 424*b* is offset from the upper edge of the second side wall panel 418, defined by the fold line 417, by a distance X'.

The top panel 416 comprises a first tab 416*a* and a second tab 416*b* which are integrally formed with the top panel 416. The first tab 416*a* and the second tab 416*b* extend the top panel 416 in a longitudinal direction. The first tab 416*a* and the second tab 416*b* are separated from the first and second side wall panels 414, 418 by corner cutaways C2, C1 respectively.

The first base panel 412 comprises a third tab 412*a* and a fourth tab 412*b* which are integrally formed with the first base panel 412. The third tab 412*a* and the fourth tab 412*b* extend the first base panel 412 in a longitudinal direction. The third tab 412*a* and the fourth tab 412*b* are separated from the first side wall panel 414 by corner cutaways C2.

The second base panel 420 comprises a fifth tab 420*a* and a sixth tab 420*b* which are integrally formed with the second base panel 420. The fifth tab 420*a* and the sixth tab 420*b* extend the second base panel 420 in a longitudinal direction. The fifth tab 420*a* and the sixth tab 420*b* are separated from the second side wall panel 418 by corner cutaways C1.

The first tab 416*a* and the second tab 416*b* are arranged to extend between the top panel 416 and the respective adjacent end closure panel 422*a*, 422*b*, 424*a*, 424*b*. In this way the first tab 416*a* and the second tab 416*b* substantially close the upper corners of a carton formed from the blank 410. The first tab 416*a* and the second tab 416*b* are bent or deformed in a set up carton; the adjacent endmost articles in the carton may act as a mandrel or guide about which the first tab 416*a* and the second tab 416*b* are erected. The first tab 416*a* and the second tab 416*b* may form a rounded corner complementary to the shape of the cutaway corners C1, C2 and/or the articles A disposed adjacent thereto. The first tab 416*a* and the second tab 416*b* serve to act as upper or minor end closure panels. In some embodiments the first tab 416*a* and the second tab 416*b* may comprise one or more fold lines to facilitate deformation thereof. In some embodiments the first tab 416*a* and the second tab 416*b* may be defined at least in part by one or more fold lines.

Similarly, when provided, the third, fourth, fifth and sixth tabs 412*a*, 412*b*, 420*a*, 420*b* substantially close the lower corners of the carton. The third, fourth, fifth and sixth tabs 412*a*, 412*b*, 420*a*, 420*b* serve to act as lower or minor end closure panels. In some embodiments the third, fourth, fifth and sixth tabs 412*a*, 412*b*, 420*a*, 420*b* may comprise one or more fold lines to facilitate deformation thereof. In some embodiments the third, fourth, fifth and sixth tabs 412*a*, 412*b*, 420*a*, 420*b* may be defined at least in part by one or more fold lines.

In some embodiments, the first tab 416*a* and the second tab 416*b* may be dimensioned such that an opening or slot is provided between a side edge of the first tab 416*a* and the second tab 416*b* and the adjacent first or second side wall panel 414, 418 proximate the cutaway corners C2, C1. In the illustrated embodiment of FIG. 10 the first and second tabs 416*a*, 416*b* are narrower in width in the transverse direction than the top panel 416 from which they depend. Similarly, when provided, the third, fourth, fifth and sixth tabs 412*a*, 412*b*, 420*a*, 420*b* may be configured to provide openings at each of the lower corners of the carton on each side of the composite base panel 412/420.

An outer surface of the first tab 416*a* and the second tab 416*b* is secured by glue or other suitable adhesive treatment to an inner surface of the respective pairs of end closure panels 422*a*/424*a*, 422*b*/424*b*.

The second tab 416*b* comprises a first adhesive region 460 and a second adhesive region 462 for securing the second tab 416*b* to the third end closure panel 422*b* and the fourth end closure panel 424*b* respectively. The material of the blank 410 forming the first and second adhesive regions 460, 462 each comprises a weakened surface such that second tab 416*b* can be readily separated from the third end closure panel 422*b* and the fourth end closure panel 424*b* when the dispenser D is deployed. In this way the second tab 416*b* can be easily detached from an assembled carton along with the detachable portion 484/480/486.

The surface of the second tab 416*b* may be weakened in the first and second adhesive regions 460, 462 by providing the first and second adhesive regions 460, 462 with a plurality of partial depth cut lines. The partial depth cut lines may be arranged as a first series of parallel cuts and a second series of parallel cuts, the second series being arranged orthogonally with respect to the first series. In alternative embodiments other arrangements of partial depth cuts may be provided.

In other embodiments the first adhesive region 460 and the second adhesive region 462 may be weakened in other ways; for example the perimeter of the first adhesive region 460 and the second adhesive region 462 may be at least partially defined by a severable line. In other embodiments the first adhesive region 460 and the second adhesive region 462 may be treated with a coating or additional layer or ply of material which reduces the bond strength between the second tab 416*b* and the third and fourth end closure panels 422*b*, 424*b*. In other embodiments corresponding areas of the inner surface of the third and fourth end closure panels 422*b*, 424*b* may be weakened in addition to, or alternatively to, weakening the outer surface of the second tab 416*b*.

Removal of the detachable portion 484/480/486 and the second tab 416*b* from the carton forms an opening through which articles A can be withdrawn or dispensed.

It can be appreciated that various changes may be made within the scope of the present invention. For example, the size and shape of the panels and apertures may be adjusted to accommodate articles of differing size or shape.

Whilst the foregoing embodiments have been described with reference to a wraparound style carton it is envisaged that the dispenser may be employed in cartons of alternative design, such as but not limited to fully enclosed cartons, basket carries and top gripping clips.

It will be recognised that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and apertures may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the term "severance line" may refer to all manner of lines formed in the blank or substrate of sheet material that facilitate separating portions of the blank or substrate of sheet material from one another, or otherwise that indicate optimal separation locations on the blank or substrate. As used herein, the term "severance line" may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines and severance lines can each includes elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a frangible fold line, or to facilitate breaking with little effort to provide a severance line.

The invention claimed is:

1. A carton for packaging one or more articles, the carton comprising a plurality of panels for forming a tubular structure, the plurality of panels comprising a top panel and a pair of first and second opposed side panels hingedly connected to first and second opposite sides of the top panel respectively, the first and second side panels having first and second corner edges respectively which are free of hinged connection to any other part of the carton, the first and second corner edges extending from the first and second sides of the top panel respectively, wherein the carton comprises a first severance line extending from the first corner and a second severance line extending from the second corner edge and the top panel comprises a third severance line extending between the first and second severance lines; wherein the top panel comprises a free end edge extending between the first and second corner edges, the free end edge being free of hinged connection to any other part of the carton.

2. A carton according to claim 1, wherein the first severance line extends into the first side panel from the first corner edge to the first side of the top panel, the second side panel comprises a second severance line extending into the second side panel from the second corner edge to the second side of the top panel.

3. A carton according to claim 1, wherein the first severance line extends from the first corner edge along a hinged connection between the first side panel and the first side of the top panel, the second side panel comprises a second severance line extending from the second corner edge along a hinged connection between the second side panel and the second side of the top panel.

4. A carton according to claim 1, wherein the first and second end closure panels are hingedly connected to end edges of the first and second side panels respectively, and wherein the end edges of the first and second side panels extend from the first and second corner edges respectively.

5. A carton according to claim 4, wherein the top panel comprises a first tab integrally formed therewith, the first tab extending between the top panel and the first and second end closure panels.

6. A carton according to claim 5, wherein the first tab comprises first and second free side edges, the first and second free side edges being free of hinged connection to any other part of the carton.

7. A carton according to claim 6, wherein the top panel comprises first and second hinged connections to the first and second side panels respectively, and wherein the first and second free side edges are inset from the first and second hinged connections respectively.

8. A carton according to claim 5, wherein the first tab forms a part of a detachable portion for forming a dispenser for facilitating access to the carton contents.

9. A carton according to claim 5, wherein the first tab is adhesively secured to at least one of the first and second end closure panels.

10. A carton according to claim 9, wherein the first tab comprises at least one weakened region for facilitating separation of the first tab from said at least one of the first and second end closure panels.

11. A carton according to claim 1, wherein the free end edge of the top panel is inset from an end edge of either one of the first and second side panels, the end edges of the first and second side panels extending from the first and second corner edges respectively.

12. A carton according to claim 1, wherein the top panel comprises a first hinged connection to the first side panel, the first hinged connection being shorter in length than the length of the first side panel.

13. A blank for forming a carton, the blank comprising a plurality of panels for forming a tubular structure, the plurality of panels comprising a top panel and a pair of first and second opposed side panels, the first and second side panels having first and second corner edges respectively which are free of hinged connection to any other part of the blank, the first and second corner edges extending from the first and second sides of the top panel respectively, wherein blank comprises a first severance line extending from the first corner edge and a second severance line extending from the second corner edge and the top panel comprises a third severance line extending between the first and second severance lines; wherein the top panel comprises a free end edge extending between the first and second corner edges, the free end edge being free of hinged connection to any other part of the carton.

* * * * *